US007553239B2

(12) United States Patent
Pullaro

(10) Patent No.: US 7,553,239 B2
(45) Date of Patent: Jun. 30, 2009

(54) SPORTS TRAINING AND CONDITIONING DEVICE

(76) Inventor: Terry Pullaro, 5 Capper Dr., St. Louis, MO (US) 63069

( * ) Notice: Subject to any disclaimer, the term of this patent is extended or adjusted under 35 U.S.C. 154(b) by 287 days.

(21) Appl. No.: 10/810,347

(22) Filed: Mar. 26, 2004

(65) Prior Publication Data

US 2005/0261075 A1 Nov. 24, 2005

Related U.S. Application Data

(63) Continuation of application No. 09/598,110, filed on Jun. 21, 2000.

(51) Int. Cl.

| | |
|---|---|
| ***A63B 49/08*** | (2006.01) |
| ***A63B 53/06*** | (2006.01) |
| ***A63B 59/00*** | (2006.01) |
| ***A63B 59/10*** | (2006.01) |
| ***A63B 59/16*** | (2006.01) |

(52) U.S. Cl. ..... 473/256; 473/519; 473/549; 473/558; 473/559; 473/564

(58) Field of Classification Search ..... 473/219, 473/226, 242, 256, 457, 463
See application file for complete search history.

(56) References Cited

U.S. PATENT DOCUMENTS

| | | | | |
|---|---|---|---|---|
| 2,756,055 | A | 7/1956 | Bittner | |
| 2,788,214 | A | 4/1957 | Tilden | |
| 3,462,156 | A | 8/1969 | Gentry | |
| 3,966,203 | A | 6/1976 | Bickford | |
| D241,958 | S * | 10/1976 | Smith | D21/791 |
| 4,272,077 | A * | 6/1981 | Spivey | 473/300 |
| 4,378,113 | A * | 3/1983 | Piccini | 482/110 |
| 4,449,708 | A | 5/1984 | Humphrey | |
| 4,600,190 | A | 7/1986 | Berokoff | |
| 4,819,935 | A * | 4/1989 | Dirksing et al. | 482/109 |
| 5,083,790 | A * | 1/1992 | Wheatley | 473/256 |
| 5,209,482 | A | 5/1993 | Hopfer | |
| 5,215,307 | A * | 6/1993 | Huffman | 473/409 |
| 5,524,893 | A | 6/1996 | McGinnis et al. | |
| 5,697,871 | A | 12/1997 | Landfair | |
| 5,769,734 | A | 6/1998 | Qualey, Sr. | |
| D428,461 | S * | 7/2000 | Koszalinski | D21/791 |
| 6,228,002 | B1 * | 5/2001 | Dantolan | 482/93 |
| 6,379,261 | B1 * | 4/2002 | Hart | 473/292 |
| 2004/0009826 | A1 | 1/2004 | Aisenberg | |
| 2005/0014571 | A1 | 1/2005 | Varner | |
| 2005/0137064 | A1 | 6/2005 | Nothnagle | |

FOREIGN PATENT DOCUMENTS

GB 2373454 A * 9/2002

OTHER PUBLICATIONS

Jackson, Jeff. The Modern Guide to Clubmaking. Ohio: Dynacraft Golf Products, Inc., copyright 1994, p. 93.*

* cited by examiner

*Primary Examiner*—Alvin A Hunter
(74) *Attorney, Agent, or Firm*—Polster Lieder Woodruff & Lucchesi, L.C.

(57) ABSTRACT

A sport-specific training and conditioning device for a sport using a hand-held implement having a grip portion, includes a handle shaped like the grip portion of the implement, the handle having first and second ends, and a weight on the second end of the handle, the center of mass of the weight being less than about 13 inches from the first end of the handle.

12 Claims, 4 Drawing Sheets

SPORTS TRAINING AND CONDITIONING DEVICE

This application is a continuation of and claims priority to co-pending application filed on Jun 21, 2000 having Ser. No. 09/598,110.

BACKGROUND OF THE INVENTION

This invention relates to a sports training and conditioning device, and in particular to a device for training and conditioning in sports which use an implement, such as a bat, a club, a racket, or stick.

There are a wide variety of sports training and conditioning devices for sports that employ some sort of implement. A common example is the batting doughnut, which is slipped over the narrow end of the bat and slid down the shaft of the bat to add extra weight to the end of the bat while taking practice swings. Similar devices are available for golf clubs and for other sports implements. One drawback with these devices is that the extra weight is usually concentrated at the remote or distal end of the sports implement. This unnecessarily strains the user, and particularly the user's shoulders, and does not concentrate the training and conditioning on the user's forearms which, in most sports, are critical to the proper use of the implement

SUMMARY OF THE INVENTION

The sports training and conditioning device of the present invention is adaptable to virtually any sport that uses a hand-held implement, including baseball, golf, tennis, squash, badminton, hockey, lacrosse, et cetera. Generally, the sports training and conditioning device of the present invention comprises a handle shaped like the grip portion of the implement for the particular sport, for example a baseball bat, having a first and second ends. A weight is mounted on the second end between about six inches and about eighteen inches from the first end of the handle, and more preferably between about eight inches and about thirteen inches from the first end of the grip. The inventor has found that for most sports, this focuses the effect of the device on the user's forearms, and reduces the stress and strain on other parts of the body. The user simply grasps the device as the user would normally grasp the sports implement, and swings the device in a controlled manner just as the user would swing the implement.

In the preferred embodiment, the circumference of the handle is between about ten percent and about thirty percent larger than the user would normally use on the corresponding sports implement, and more preferably about 20 percent larger. The inventor has found that this increased circumference of the handle further focuses the effect of the device on the forearms.

The sports training and conditioning devices of the present invention are of simple and inexpensive construction. They are compact and easy to store and transport. The devices provide sports-specific strengthening and conditioning, focusing on the user's forearms while minimizing stress and strain on other parts of the user's body, such as the shoulder and wrists. Using the device during practice helps program a proper motion through "muscle memory". These and other features and advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE INVENTION

Figure 1:
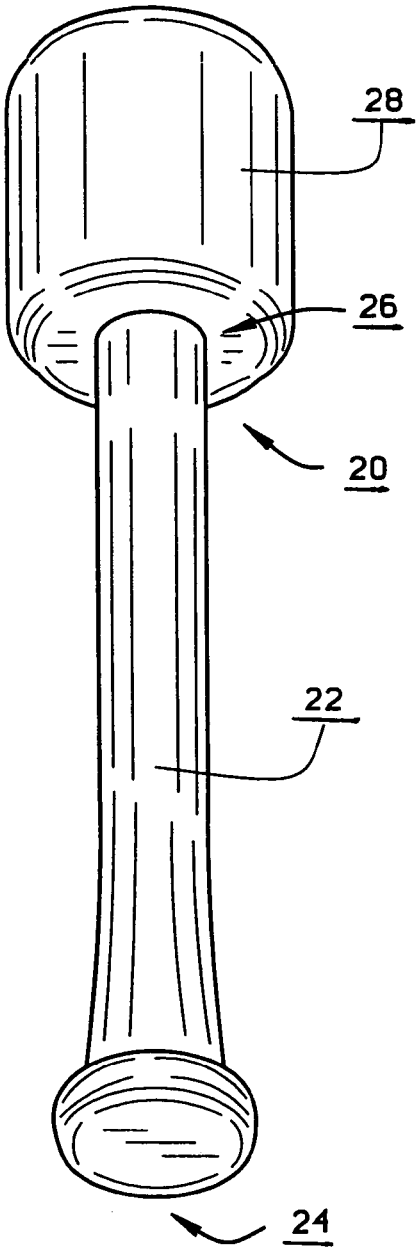
FIG. 1 is a perspective view of a first embodiment of a sports training device constructed according to the principles of this invention.
Figure 2:
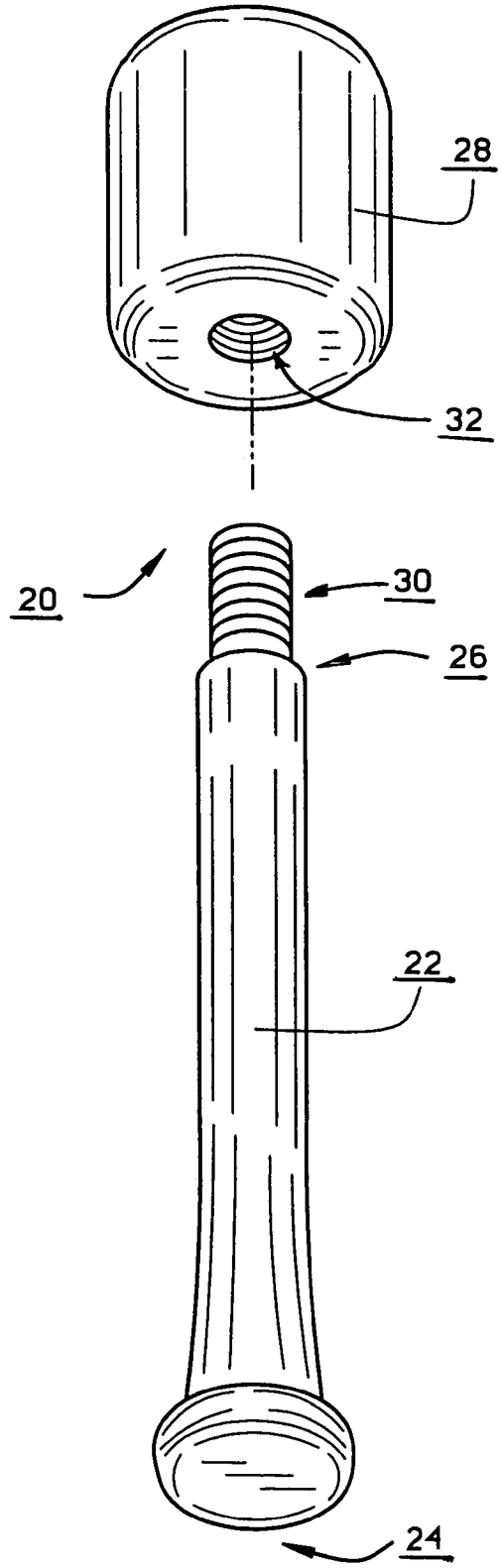
FIG. 2 is a perspective view of the device of the first embodiment, disassembled to show the details of construction.
Figure 3:
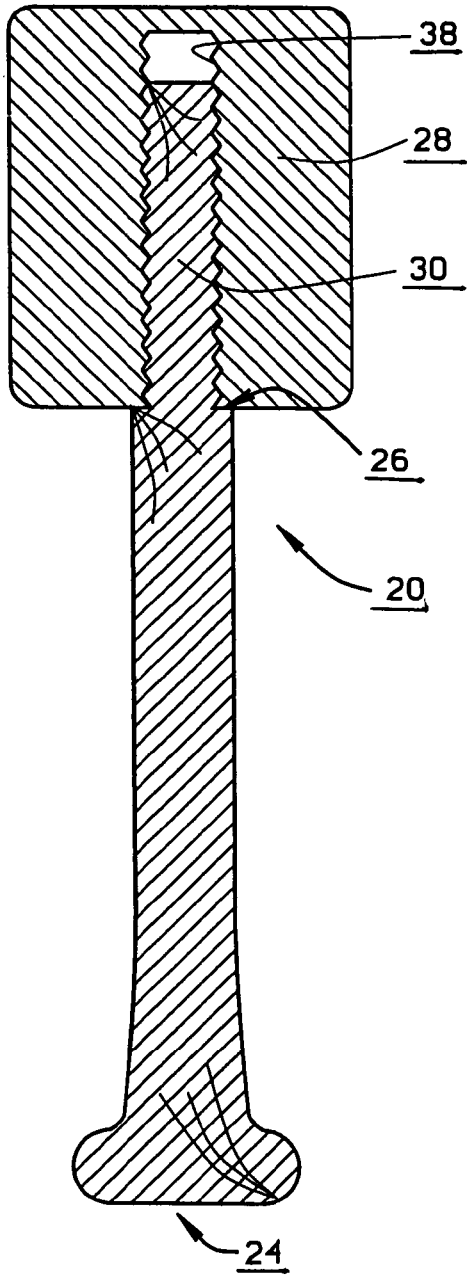
FIG. 3 is a longitudinal cross-sectional view of the device of the first embodiment, showing details of construction.

A first embodiment of a sports training and conditioning device constructed according to the principles of this invention is indicated generally as 20 in FIGS. 1 through 3. The device 20 is particular adapted for training and conditioning for sports which involve the use of an implement having a grip, e.g., a bat, a club, a racket, or a stick, and in particular device 20 is adapted for training and conditioning for baseball, softball, and other sports which employ a bat. The device 20 comprises a handle 22 configured like the grip portion of the sports implement, thus device 20 has a grip configured like the handle portion of a bat, having a first end 24 and a second end 26. The first end 24 corresponds to the normal proximal end (i.e., the end closest to the user) of the sports implement, the second end 26 corresponds to normal distal end (i.e., the end furthest from the user). The handle 22 is preferably made of wood, like a conventional bat, but it could also be made of some other material.

In the preferred embodiment the circumference of the handle is preferably between about ten and about thirty percent larger than the grip portion of a conventional sports implement, and most preferably about twenty percent larger than the grip portion of a conventional sports implement. The inventor has discovered that this helps focus the effect of the device on the user's forearms, yet still permits the user to securely grasp the device. Thus, in the case of device 20, where a conventional bat would have a grip diameter of between about ⅞ inches and about 1 and ⅛ inches, the handle 22 preferably has a diameter of between about 1¼ inches and about 1½ inches, and most preferably about 1 and {fraction (11/32)} inches. The larger grip both isolates the forearms and safely strengthens the hands and wrists. However, the handle 22 could have the circumference of a conventional bat.

A weight 28 is mounted on the second end 26 of the handle 22. The weight 28 is preferably made of steel, but could, of course be made of some other dense material. The length of the handle 22 and the size and shape of the weight 28 are such that the center of mass of the device is positioned distally beyond the graspable portion of the handle 22, between about 8½ inches and about 15 inches from the first end 24 of the handle 22, and more preferably between about 10 and 13 inches from the first end of the handle 22. The weight of the weight 28 depends upon the needs and preferences of the user, the weight 28 may have a weight so that the device 20 weighs 3½, 5, 7 ½, 10, or 12½ pounds, or preferably a set of devices 20 of different weights 28 are provided.

As shown in the FIGS., the weight 28 preferably has a generally cylindrical shape, and the top and bottom edges of the cylinder are preferably rounded. Of course the weight 28 could have some other shape, for example with a polygonal cross section, or the weight could be a rectangular prism. However, the inventor believes that the compact, cylindrical shape improves the swing dynamics of the device. In the preferred embodiment, the weight 28 for the 3½ pound device has a diameter of about 2⅜ inches, and is about 2½ inches high; the weight 28 for the 5 pound device has a diameter of about 3 inches, and is about 2¾ inches high; the weight 28 for the 7½ pound device has a diameter of about 3½ inches, and is about 3 inches high; the weight 28 for the 10 pound device has a diameter of about 3¾ inches, and is about 3¾ inches high; and the weight 28 for the 12½ pound device has a diameter of about 4 inches, and is about 4 inches high.

In the preferred construction of the first embodiment, the distal end 26 has external threaded projection 30 that is adapted to fit into an internally threaded socket 32 in the weight 28. The threaded projection 30 may be further secured in the socket 32 with an adhesive, such as an epoxy or other suitable adhesive. However, it may be desirable to have the weight 28 removably mounted on the handle 22, so that the user can have just one handle, and change the weight of the device 20 by changing the weight 28.

Figure 4:
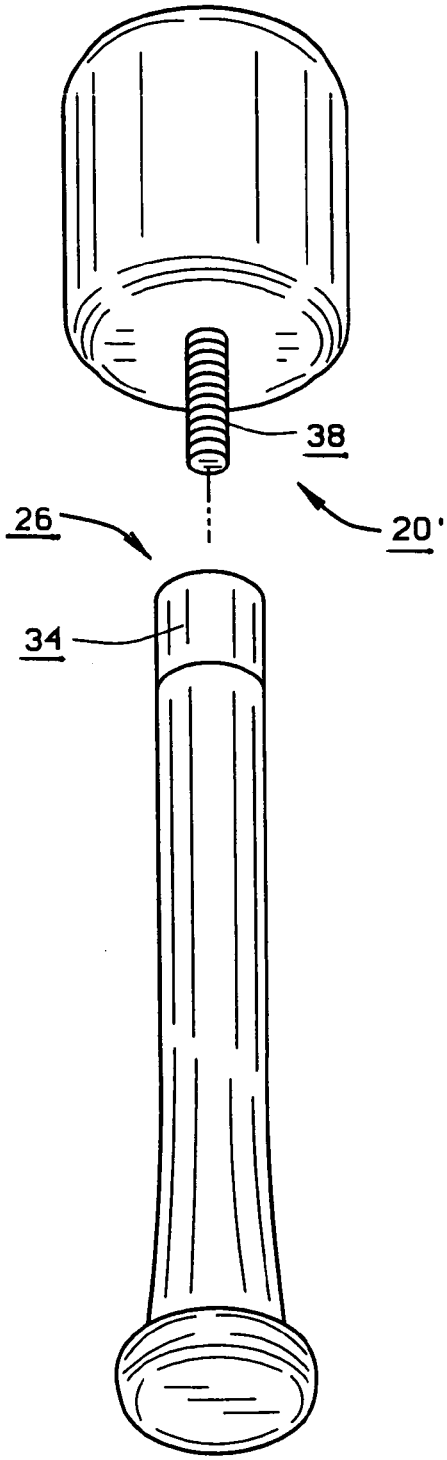
FIG. 4 is a perspective view of a first alternate construction of the device of the first embodiment.

A first alternate construction of the first embodiment of a sports training and conditioning device is indicated generally as 20' in FIG. 4. The device 20' is similar in construction to device 20, comprising a handle 22 and a weight 28. However, in device 20' the attachment of the weight 28 to the handle 22 is different from the attachment in device 20. As shown in FIG. 4, there is a collar 34 with an internally threaded socket mounted on the second end 24 of the handle 22. The collar 34 is preferably made of metal and is secured on the handle by any conventional means. There is an externally threaded stud 38 on the weight 28 that threads into the internally threaded socket in the collar 34.

Figure 5:
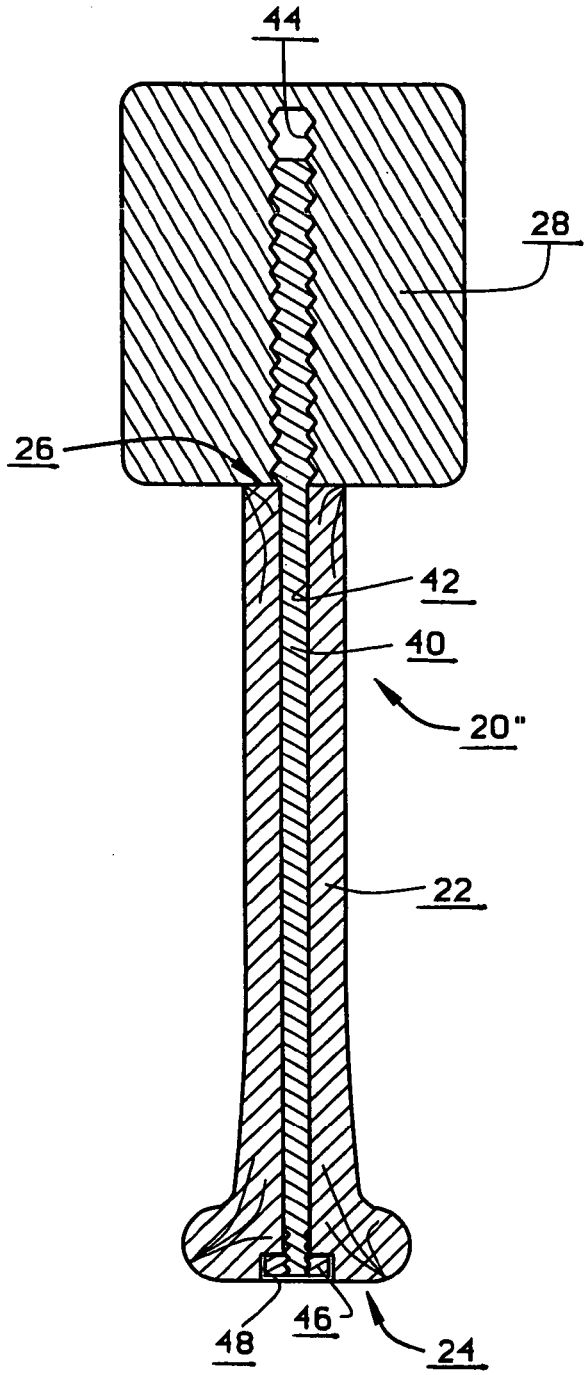
FIG. 5 is a longitudinal cross sectional view of a second alternate construction of the device of the first embodiment.

A second alternate construction of the first embodiment of a sports training and conditioning device is indicated generally as 20" in FIG. 5. The device 20" is similar in construction to device 20, comprising a handle 22 and a weight 28. However, in device 20" the attachment of the weight 28 to the handle 22 is different from the attachment in device 20. As shown in FIG. 5, a threaded bolt 40 extends through an axial bore 42 in the handle 22, projecting out the second end 26 of the handle 22. The bolt 40 is preferably made of metal. The weight 28 preferably has an internally threaded socket 44 to receive the bolt 40. A nut 46 is threaded on the end of the bolt 40 and is concealed in a recess 48 in the first end of the handle 22.

Figure 6:
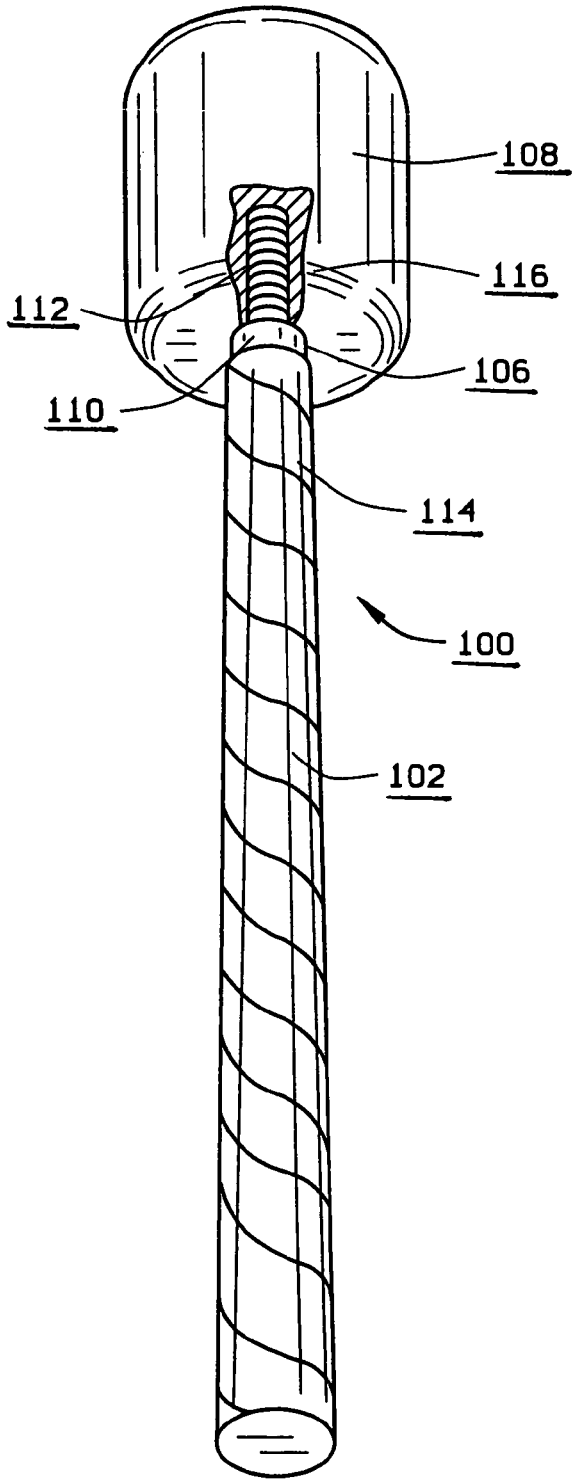
FIG. 6 is a perspective view of a second embodiment of a sports training device constructed according to the principles of this invention, with a portion broken away to reveal details of construction.

A second embodiment of a sports training and conditioning device is indicated generally as 100 in FIG. 6. The device 100 is particularly adapted for training and conditioning for the sport of golf, and comprises a handle 102 configured like the grip portion of a golf club, having a first end 104 and a second end 106. The first end 104 corresponds to the normal proximal end (i.e., the end closest to the user) of the sports implement, the second end 106 corresponds to normal distal end (i.e., the end furthest from the user).

In the preferred embodiment the circumference of the handle 102 is preferably between about ten and about thirty percent larger than the grip portion of a conventional sports implement, and most preferably about twenty percent larger than the grip portion of a conventional sports implement. The inventor has discovered that this helps focus the effect of the device 100 on the user's forearms, yet still permits the user to securely grasp the device 100. Thus, in the case of device 100, where a conventional golf club would have a grip circumference of between about 2¾ inches and about 3 inches, the handle 102 preferably has a circumference of between about 3 inches and about 3½ inches. However, the handle 102 could have the circumference of a conventional golf club.

A weight 108 is mounted on the second end 106 of the handle 102. The weight 108 is preferably made of steel, but could, of course, be made of some other dense material. The length of the handle 102 and the size and shape of the weight 108 are such that the center of mass of the device is positioned distally between about 8 inches and about 15 inches from the first end 104 of the device 100, and more preferably between about 10 and 13 inches. The weight of the weight 108 depends upon the needs and preferences of the user, the weight 108 may have a weight so that the device 100 weighs 3½, 5, 7½, 10, or 12½ pounds, or preferably a set of devices 100 of different weights 108 are provided.

As shown in FIG. 6, the weight 108 preferably has a generally cylindrical shape, and the top and bottom edges of the cylinder are preferably rounded. Of course the weight 108 could have some other shape, for example with a polygonal cross section, or the weight 108 could be a rectangular prism. In the preferred embodiment, the weight 108 for the 3½ pound device has a diameter of about 2⅜ inches, and is about 2½ inches high; the weight for the 5 pound device has a diameter of about 3 inches, and is about 2¾ inches high; the weight 108 for the 7½ pound device has a diameter of about 3½ inches, and is about 3 inches high; the weight 108 for the 10 pound device has a diameter of about 3¾ inches, and is about 3¾ inches high; and the weight 108 for the 12½ pound device has a diameter of about 4 inches, and is about 4 inches high for the 3½ pound device has a diameter of about 2⅜ inches, and is about 2½ inches high; the weight 108 for the 5 pound device has a diameter of about 3 inches, and is about 2¾ inches high; the weight 108 for the 7½ pound device has a diameter of about 3½ inches, and is about 3 inches high; the weight 108 for the 10 pound device has a diameter of about 3¾ inches, and is about 3¾ inches high; and the weight 108 for the 12½ pound device has a diameter of about 4 inches, and is about 4 inches high.

In the preferred construction of the device 100, the grip 102 comprises a rod 110 with an externally threaded stud 112 on its second end 106. The rod 110 is covered with a conventional golf club grip 114. The threaded stud 112 is adapted to fit in an internally threaded socket 116 in the weight 108. The threaded stud 112 may be further secured in the socket 116 with an adhesive, such as an epoxy or other suitable adhesive. However, it may be desirable to have the weight 108 removably mounted on the handle 102, so that the user can have just one handle, and change the weight of the device 100 by changing the weight 108. Of course one of the other attachments for the weight 108 and handle 102 discussed above with respect to device 20, or any other method for securely connecting the weight 108 and the handle 102 can be used.

Figure 7:
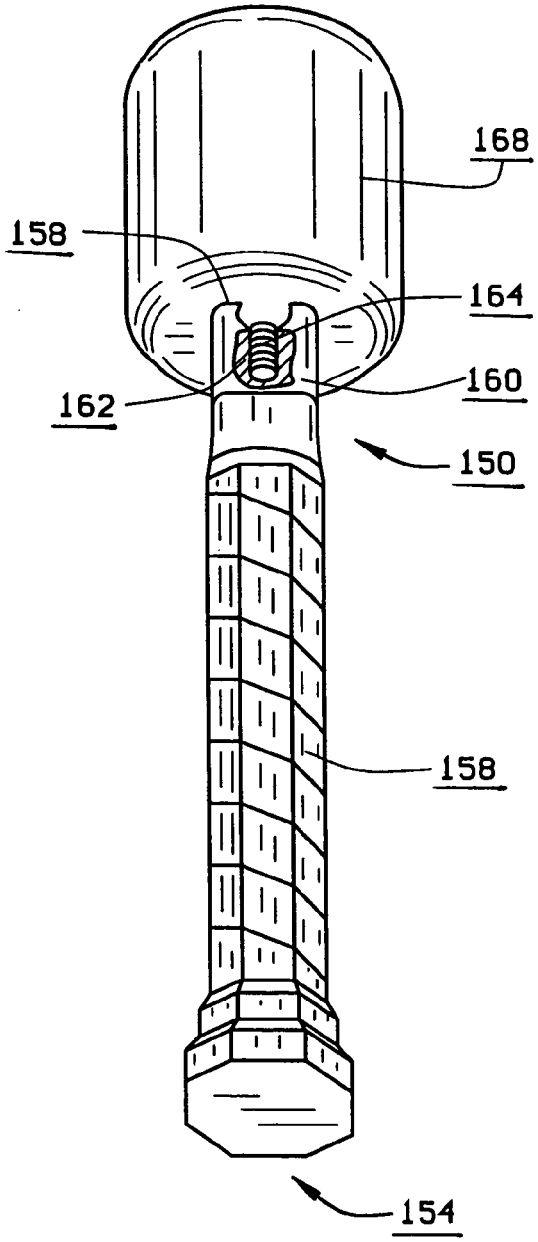
FIG. 7 is a perspective view of a second embodiment of a sports training device constructed according to the principles of this invention, with a portion broken away to reveal details of construction.

A third embodiment of a sports training and conditioning device is indicated generally as 150 in FIG. 7. The device 150 is particularly adapted for training and conditioning for the sport of tennis, and comprises a grip 152 configured like the handle portion of a tennis racket, having a first end 154 and a second end 156. The first end 154 corresponds to the normal proximal end (i.e., the end closest to the user) of the sports implement, the second end 156 corresponds to normal distal end (i.e. the end furthest from the user). The handle 152 is preferably made of wood, metal, or a composite material, like a conventional racket, but it could also be made of some other material.

In the preferred embodiment the circumference of the handle 152 is preferably between about ten and about thirty percent larger than the grip portion of a conventional sports implement, and most preferably about twenty percent larger than the grip portion of a conventional sports implement. The inventor has discovered that this helps focus the effect of the device 150 on the user's forearms, yet still permits the user to securely grasp the device 150 Thus in the case of device 150, where a conventional racket would have a grip circumference of between about 4¼ inches and about 4⅝ inches, the handle 152 preferably has a circumference of between about 4⅜ inches and about 4¾ inches. However, the handle 152 could have the circumference of a conventional racket. The handle 152 may include a conventional spiral wrap of leather or leather-like material, so that the handle 152 of the device 150 has the appearance and feel of the grip portion of a conventional racket.

A weight 158 is mounted on the second end 156 of the handle 152. The weight 158 is preferably made of steel, but could, of course be made of some other dense material. The length of the handle 152 and the size and shape of the weight 158 are such that the center of mass of the device 150 is positioned between about 8 inches and about 15 inches from the first end 154 of the handle 152, and more preferably between about 10 and 13 from the first end 154 of the handle 152. The center of mass is preferably distal to the graspable portion of the handle 152. The weight of the weight 158 depends upon the needs and preferences of the user, the weight 158 may have a weight so that the device 150 weighs 1½, 2½, 3½, 4½, or 5½ pounds, or preferably a set of devices 150 of different weights 158 are provided.

As shown in FIG. 7, the weight 158 preferably has a generally cylindrical shape, and the top and bottom edges of the cylinder are preferably rounded. Of course the weight 158 could have some other shape, for example with a polygonal cross section, or the weight 158 could be a rectangular prism. In the preferred embodiment, the weight 158 for the 1½ pound device has a diameter of about 1⅞ inches, and is about 2 inches high; the weight 158 for the 2½ pound device has a diameter of about 2⅛ inches, and is about 2¼ inches high; the weight 158 for the 3½ pound device has a diameter of about 2⅜ inches, and is about 2½ inches high; the weight 158 for the 4½ pound device has a diameter of about 2½ inches, and is about 2⅝ inches high; and the weight 158 for the 5½ device has a diameter of about 2⅝ inches, and is about 2⅞ inches high.

In the preferred construction of the third embodiment, there is a collar 160 with an internally threaded socket 162 mounted on the second end 154 of the handle 152. The collar 160 is preferably made of metal and is secured on the handle by any conventional means. There is an externally threaded stud 164 on the weight 158 that threads into the internally threaded socket in the collar 160. The threaded stud 164 may be further secured in the socket 160 with an adhesive, such as an epoxy or other suitable adhesive. However, it may be desirable to have the weight 158 removably mounted on the handle 152, so that the user can have just one handle, and change the weight of the device 150 by changing the weight 158. Of course one of the other attachments for the weight 158 and handle 152 discussed above with respect to device 20, or any other method for securely connecting the weight 158 and the handle 152 can be used.

Figure 8:
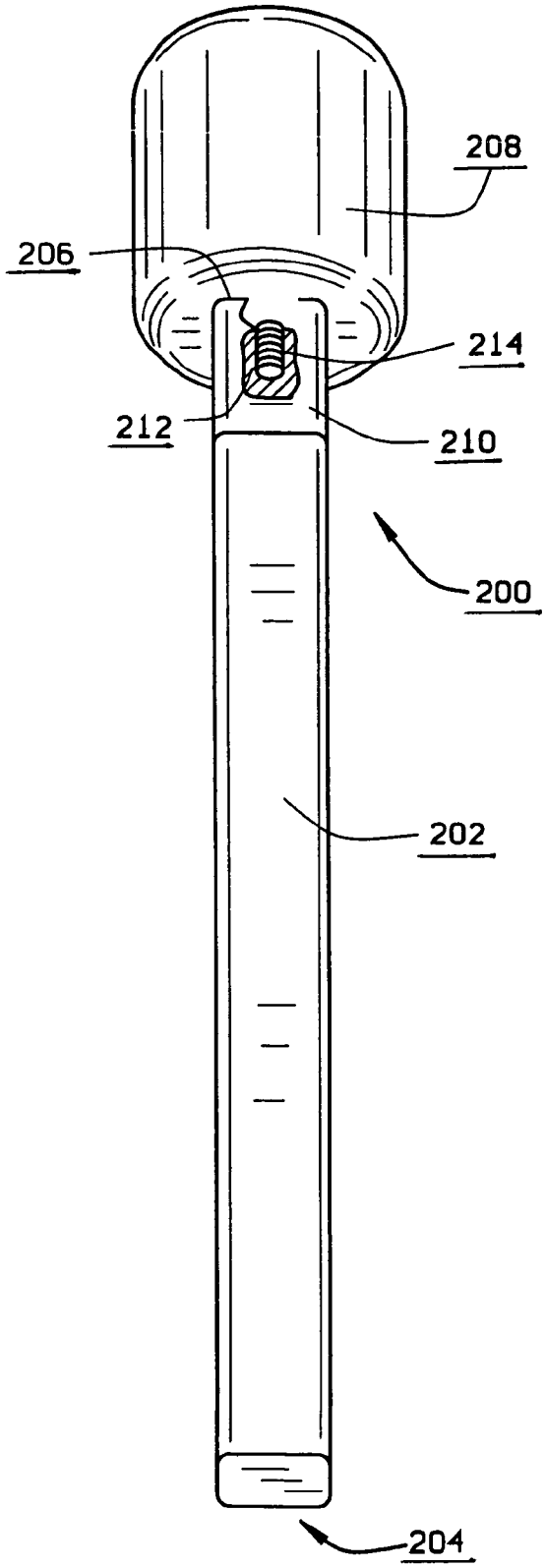
FIG. 8 is a perspective view of a second embodiment of a sports training device constructed according to the principles of this invention, with a portion broken away to reveal details of construction.

A fourth embodiment of a sports training and conditioning device is indicated generally as 200 in FIG. 8. The device 200 is particularly adapted for training and conditioning for the sport of hockey, and comprises a grip 202 configured like the handle portion of a hockey stock, having a first end 204 and a second end 206. The first end 204 corresponds to the normal proximal end (i.e., the end closest to the user) of the sports implement, the second end 206 corresponds to normal distal end (i.e., the end furthest from the user). The handle 202 is preferably made of wood, like a conventional hockey stick, but it could also be made of some other material.

In the preferred embodiment the circumference of the handle 202 is preferably between about ten and about thirty percent larger than the grip portion of a conventional sports implement, and most preferably about twenty percent larger than the grip portion of a conventional sports implement. The inventor has discovered that this helps focus the effect of the device 200 on the user's forearms, yet still permits the user to securely grasp the device 200. Thus, in the case of device 200, where a conventional stick would have a grip circumference of between about 3¾ inches and about 4¼ inches, the handle 202 preferably has a circumference of between about 4 inches and about 4½ inches. However, the handle 202 could have the circumference of a conventional racket.

A weight 208 is mounted on the second end 206 of the handle 202. The weight 208 is preferably made of steel, but could, of course be made of some other dense material. The length of the handle 202 and the size and shape of the weight 208 are such that the center of mass of the device 200 is positioned between about 8½ inches and about 15 inches from the first end 204 of the handle 202, and more preferably between about 10 and 13 inches from the first end of the handle 202. The center of the mass of the device is preferably distal to the end of the graspable portion of the handle 202 The weight of the weight 208 depends upon the needs and preferences of the user, the weight 208 may have a weight so that the device 200 weighs 3½, 5, 7½, 10, or 12½ pounds, or preferably a set of devices 200 of different weights 208 are provided.

As shown in FIG. 8, the weight 208 preferably has a generally cylindrical shape, and the top and bottom edges of the cylinder are preferably rounded, Of course the weight 208 could have some other shape, for example with a polygonal cross section, or the weight 208 could be a rectangular prism. However, the inventor believes that the compact, cylindrical shape improves the swing dynamics of the device 200. In the preferred embodiment, the weight 208 for the 3½ pound device has a diameter of about 2⅜ inches, and is about 2½ inches high; the weight 208 for the 5 pound device has a diameter of about 3 inches, and is about 2¾ inches high; the weight 208 for the 7½ pound device has a diameter of about 3½ inches, and is about 3 inches high; the weight 208 for the 10 pound device has a diameter of about 3¾ inches, and is about 3¾ inches high; and the weight 208 for the 12½ pound device has a diameter of about 4 inches, and is about 4 inches high.

In the preferred construction of the third embodiment, there is a collar 210 with an internally threaded socket 212 mounted on the second end 204 of the handle 202. The collar 210 is preferably made of metal and is secured on the handle by any conventional means. There is an externally threaded stud 214 on the weight 208 that threads into the internally threaded socket in the collar 210. The threaded stud 214 may be further secured in the socket 210 with an adhesive, such as an epoxy or other suitable adhesive. However, it may be desirable to have the weight 208 removably mounted on the handle 202, so that the user can have just one handle, and change the weight of the device 200 by changing the weight 208. Of course one of the other attachments for the weight 208 and handle 202 discussed above with respect to device 20, or any other method for securely connecting the weight 208 and the handle can be used.

OPERATION

In operation, any of the devices 20, 20', 20", 100, 150, or 200 of this invention, is grasped by the user. (Of course a device can be constructed according to the principles of this invention for any sport in which the participant grasps and swings a sports implement.) The user then swings the device, much as the user would swing the implement which the device emulates. By controlling the size and shape and placement of the weight on the end of the handle, the training and conditioning effects are focused on the user's forearms. In particular, it is believe that by positioning the center of mass of the weight within 13 inches of the first end of the handle, the effect of the device is focused on the user's forearms. More specifically it is important that the center of mass of the device is past the graspable portion of the handle, yet within 13 inches of the first end of the handle.

What is claimed is:

1. A sport-specific training and conditioning device for a sport using a hand-held implement having a grip portion, the device comprising a handle shaped like the grip portion of the implement, the handle having first and second ends, the device further comprising a single uniformly shaped weight that is internally fastened with the second end of the handle while the first end of the handle remains weight free such that the internal fastening of the uniformly shaped weight with the second end fastens the uniformly shaped weight to a normally non-rotatable position and such that a center of mass of the device is positioned within the uniformly shaped weight and the center of mass is less than about thirteen inches from the first end of the handle, the handle having a circumference sized between about ten and about thirty percent larger than the grip portion of the hand-held implement and the handle having a length that is longer than the uniformly shaped weight wherein the positioning of the uniformly shaped weight, the sizing of the circumference of the handle and the positioning of the center of mass are configured to direct the effect of the uniformly shaped weight in a concentrated manner to the forearms of the user during exercise with the device.

2. The sport-specific training and conditioning device according to claim 1 wherein the uniformly shaped weight has a diameter of less than about 4 inches.

3. The sport-specific training and conditioning device according to claim 1 wherein the uniformly shaped weight has a length of less than about 4 inches.

4. The sport-specific training and conditioning device according to claim 1 wherein the device weights more than the hand-held implement used in the sport.

5. The sport-specific training and conditioning device according to claim 1 wherein one of the handle and the uniformly shaped weight includes an externally threaded portion, and wherein the other of the handle and the uniformly shaped weight includes an internally threaded socket.

6. The sport-specific training and conditioning device according to claim 5 wherein the handle includes an externally threaded portion and the uniformly shaped weight includes an internally threaded socket.

7. The sport-specific training and conditioning device according to claim 1 wherein the handle is shaped like the grip portion of a bat.

8. The sport-specific training and conditioning device according to claim 1 wherein the handle is shaped like the grip portion of a racket.

9. The sport-specific training and conditioning device according to claim 8 wherein the grip is shaped like the grip portion of a tennis racket.

10. The sport-specific training and conditioning device according to claim 1 wherein the handle is shaped like the grip portion of a golf club.

11. The sport-specific training and conditioning device according to claim 1 wherein the handle is like the grip portion of a hockey stick.

12. The sport-specific training and conditioning device according to claim 1 wherein the handle is less than about 10 inches long.

* * * * *